US005449028A

United States Patent [19]

Sindoni

[11] Patent Number: 5,449,028

[45] Date of Patent: Sep. 12, 1995

[54] DELIVERY DEVICE, ESPECIALLY FOR COLORS AND PAINTS

[75] Inventor: Giuseppe Sindoni, Milan, Italy

[73] Assignee: Italtinto S.r.l., Genoa, Italy

[21] Appl. No.: 182,755

[22] Filed: Jan. 18, 1994

[30] Foreign Application Priority Data

Oct. 14, 1993 [IT] Italy ..... MI93A2178

[51] Int. Cl.[6] ..... B65B 1/04; B65B 3/04

[52] U.S. Cl. ..... 141/110; 141/104; 141/87; 141/85; 222/190

[58] Field of Search ..... 141/104, 105, 110, 234, 141/85, 90, 91, 311 A, 86, 87, 88, 369, 370, 371, 379; 222/108, 111, 190, 145

[56] References Cited

U.S. PATENT DOCUMENTS

| | | | |
|---|---|---|---|
| 4,096,893 | 6/1978 | Harvey, Jr. et al. | 141/90 |
| 4,572,252 | 2/1986 | Ponzi et al. | 141/90 |
| 4,705,083 | 11/1987 | Rossetti | 141/104 |
| 4,811,872 | 3/1989 | Boyd | 141/86 |
| 4,967,938 | 11/1990 | Hellenberg | 141/104 |

*Primary Examiner*—Henry J. Recla
*Assistant Examiner*—Steven O. Douglas
*Attorney, Agent, or Firm*—Notaro & Michalos

[57] ABSTRACT

A delivery device, especially for color and paints, has a plurality of nozzles or delivery ducts. The ducts being one connected to their own tank and arranged in such a way as to discharge into a single chamber which is directed into an underlying container. Around the discharge nozzles, a sealed chamber with removable bottom is provided.

10 Claims, 1 Drawing Sheet

DELIVERY DEVICE, ESPECIALLY FOR COLORS AND PAINTS

FIELD AND BACKGROUND OF THE INVENTION

The present invention relates to a delivery device, especially for colors and paints. From Italian patent 1 101 064 and 0 215 555, of the same applicant, delivery devices for the same application are known.

These delivery devices comprise a plurality of nozzles, which are usually radially arranged, the nozzles being each connected to their own color tank. The color delivered from the nozzles falls into an underlying container, which is typically a can. When a color flow is interrupted, in the nozzle or delivery duct there will almost always remain a certain amount of said color.

The liquid phase of the color is prone to evaporate as it is in contact with the atmosphere, thereby causing the color to dry up and the delivery duct to clog. The currently known delivery devices, especially for colors and paints, require consequently frequent troublesome maintenance operations.

SUMMARY OF THE INVENTION

The specific object of the present invention is to overcome the above-mentioned draw-backs and find a delivery device, especially for colors and paints, which allows the colour remaining in the delivery ducts during a flow interruption phase, to remain unaltered. A further object of the present invention is to provide a delivery device of a simple, low-cost construction. The above and other objects are achieved in a delivery device, especially for colors and paints, of the kind comprising a plurality of nozzles, or delivery ducts, characterized in that it comprises, around the discharge nozzles, a tight-sealed chamber with removable bottom.

BRIEF DESCRIPTION OF THE DRAWING

Further features and advantages of the invention will be more clearly understood from the description of a preferred, but not exclusive, embodiment of the delivery device, especially for colors and paints, which is illustratively shown in the accompanying drawing, in which.

DESCRIPTION OF THE PREFERRED EMBODIMENT

Figure 1:
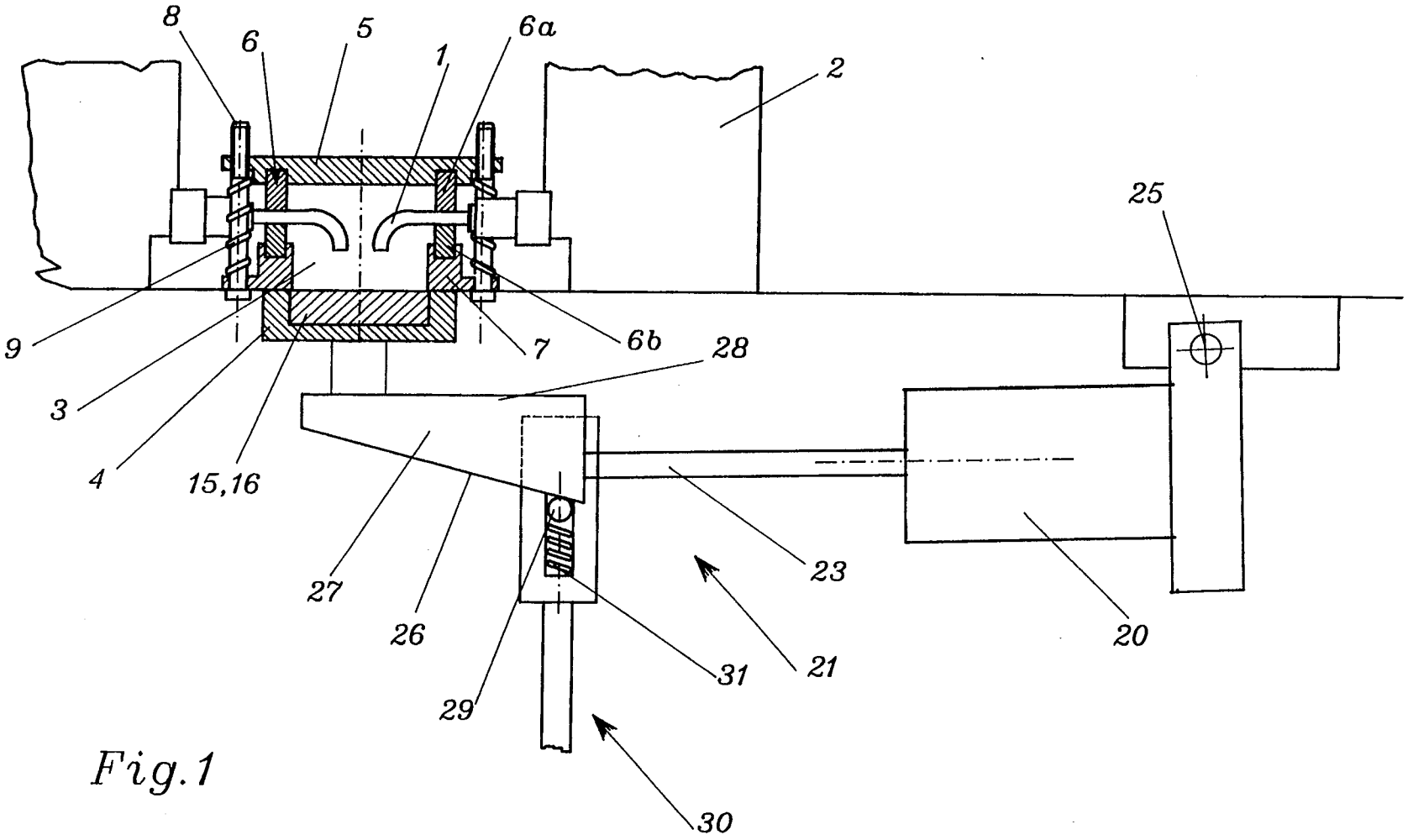
FIG. 1 is a side elevation view, partly in section, of the device in stand-by condition, which embodiment must not be construed as limiting.

With reference to the sole figure, the device comprises a plurality of discharge nozzles, or ducts, 1 for delivering the color that is contained within tanks 2. The nozzles are radially arranged and discharge into a tight-sealed chamber 3 which is closed in the lower part by a removable bottom 4 and in the upper part by a cover 5, said cover 5 being located over the array of nozzles 1 and forming part of the chamber means that forms chamber 31.

The side wall of the chamber consists of a flange 7 which is located under the array of nozzles 1, and a gasket 6, said gasket comprising two parts superposed to one another and being constrained between cover 5 and flange 7, so as to tighten, under deformation, the array of nozzles 1. One part of gasket 6, at 6*a* is above the nozzles 1 and the other part 6*b*, is below the nozzles.

Cover 5 is mounted on two or several screws or threaded spindles 8 with the interposition of springs 9 that are biased to raise the cover away from the flange 7, thereby separating the two parts that form gasket 6. Thus it is possible to raise cover 5 for a distance that is enough to remove one or several nozzles for maintenance operations, without the chamber having to be dismantled. The gasket forms seal means for scaling the chambers.

The removable bottom 4 of tight-sealed chamber 3 preferably comprises on the inner side a cavity 15 which is filled with a sponge 16, said sponge being soaked in the same liquid that forms the liquid phase of the color.

When the tight-sealed chamber is closed, the liquid in which the sponge is soaked evaporates until an equilibrium with the vapour pressure of the liquid contained in the color is reached.

The tight-sealed chamber 3 provides therefore a controlled atmosphere which warrants that the color remaining in the nozzles can not be deteriorated.

The removable bottom 4 is controlled by a linear actuator 20 which, through a kinematic motion system 21, causes bottom 4 to be drawn and removed from the lower part of flange 7. Activator 20 is, for example, an air piston.

The kinematic motion system 21 comprises a rod 23 of the linear actuator 20 which is hinged 16 25 and moves rod 23, said rod being connected to a wedge-like support 27 to which the bottom 4 of tight-sealed chamber 3 is fixed.

The lower surface 26 of wedge 22 rests on a sphere 29 which is mounted on a support 30 and biased upwardly by a spring 31, thereby pushing with a controlled force the removable bottom 4 against the bottom part of chamber 3. On the upper surface 28 of wedge 27 there is fixed the bottom 4 that closes the tight-sealed chamber 3. In stand-by conditions, the delivery device shows the tight-sealed chamber 3, that is the bottom 4, pressed against flange 7.

The stopper 4 is preferably made of a material exhibiting a certain elasticity so as to warrant a good seal on the flange.

Before the colour delivery is resumed, the stopper 4 is removed by actuating the kinematic motion system 21. The opening/closing kinematic motion system of tight-sealed chamber 3 works as follows:

the linear actuator 20 acts on rod 23 drawing it back, which consequently draws-back wedge 27 on which the stopper 4 is fixed.

The linear actuator 20 is hinged at 25, that it can be rotated, allowing the wedge 27 to be lowered while it is drawn back.

The lower surface 26 of wedge 27 slides on sphere 29, which can freely rotate in its seat, which allows a low friction coefficient to be obtained.

When the device has completed the color delivery, chamber 3 is closed by reversing the operation sequence described above.

In case of failure or misoperation within the tight-sealed chamber, it is enough to unscrew screws 8 for the springs 9 to raise cover 5 thereby separating the two parts 6*a* and 6*b* of gasket 6 and allowing one or more nozzles to be removed without the need of troublesome removal operations of said cover.

Many changes and variations can be performed on the invention described above, all of which fall within the scope of the inventive idea.

In practice, any materials can be employed and the dimension can be chosen according to the needs.

I claim:

1. A delivery device, especially for liquid containing colors comprising: a plurality of delivery ducts for delivering said liquid containing colors; a tank connected to each duct for supplying the liquid containing colors to the ducts; a chamber means having a closed top and an open bottom, said ducts being arranged within said chamber means in an array to discharge through said open bottom of said chamber means, said chamber means open bottom defined by a lower end thereof adapted to be aligned with an underlying container; a removable bottom connected to the lower end for closing said chamber means; and seal means for sealing said delivery ducts to said chambers means so that said chamber means is sealed closed when said bottom closes the lower end of said chamber means, to limit evaporation of the liquid which is in the ducts and avoid drying out of the colors.

2. A device as claimed in claim 1, wherein said chamber means includes means that contain a predetermined amount of the liquid which upon evaporation produces an equilibrium with a vapor pressure of the same liquid present in the ducts so as to avoid further evaporation of the liquid in the ducts.

3. A device as claimed in claim 2, wherein the removable bottom has an inner side with a cavity, and a sponge in said cavity which is soaked in the liquid to form the predetermined amount of liquid.

4. A device as claimed in claim 1, wherein said chamber means comprises: a cover located over the array of ducts and a flange located under the array of ducts; said seal means comprising a gasket having two superposed parts and radially crossed by the array of ducts, one part of the gasket being over the ducts and the other part of the gasket being under the ducts, said gasket being constrained between the cover and flange, so as to tighten, under deformation of the gasket, around the array of nozzles; and a plurality of screws for tightening the cover to the flange.

5. A device as claimed in claim 4, wherein, on at least two of said screws, elastic means are present, said elastic means tending to raise the cover way from the flange.

6. A device as claimed in claim 1, including a kinematic motion system connected to the bottom for moving the bottom to close and open the lower end of the chamber means , said kinematic motion system comprising: a linear actuator, said linear actuator pivoting around an axis that is perpendicular to a translation direction of said linear actuator; a wedge having an upper surface to which said bottom is fixed, said wedge being directly connected to said linear actuator; and fixed abutment means on which said wedge moves.

7. A device as claimed in claim 6, wherein said fixed abutment means on which the wedge-moves comprises: a sphere on which said wedge slides.

8. A device as claimed in claim 7, including elastic means provided for setting a pressure that the bottom applies against the lower end of the chamber means.

9. A device as claimed in claim 8, wherein said elastic means for setting the pressure the bottom applies, consists of a spring for biasing said sphere against the wedge.

10. A device as claimed in claim 6, wherein said linear actuator is an air piston.

* * * * *